United States Patent [19]

Hofsäss

[11] 4,330,773

[45] May 18, 1982

[54] COIL FORM WITH HEAT SWITCH

[76] Inventor: Peter Hofsäss, Strietweg 45, D-7530 Pforzheim, Fed. Rep. of Germany

[21] Appl. No.: 143,774

[22] Filed: Apr. 25, 1980

[30] Foreign Application Priority Data

Apr. 25, 1979 [DE] Fed. Rep. of Germany ..... 2916639
Apr. 25, 1979 [DE] Fed. Rep. of Germany ..... 2916664

[51] Int. Cl.[3] ..... H01H 37/54
[52] U.S. Cl. ..... 337/365; 337/369
[58] Field of Search ..... 337/53, 89, 343, 362, 337/365, 369, 370, 372, 380

[56] References Cited

U.S. PATENT DOCUMENTS

| | | | |
|---|---|---|---|
| 3,386,066 | 5/1968 | Audette | 337/365 |
| 3,430,177 | 2/1969 | Audette | 337/365 |
| 4,149,138 | 4/1979 | Pevzner et al. | 337/372 |
| 4,157,525 | 6/1979 | Grable | 337/365 |

*Primary Examiner*—George Harris

*Attorney, Agent, or Firm*—Craig and Antonelli

[57] ABSTRACT

A coil form for accommodating at least one coil winding and a heat switch. The coil form includes a recess for receiving the heat switch and the heat switch includes at least one switching element and a housing, at least a portion of which is adapted to be inserted into the recess. The housing is open at least in an area thereof adapted to be inserted into the recess and a portion of the housing serves for closing off the recess. The heat switch includes a base body and fixed connection elements on the base body which are insulated from each other. The heat switch includes a contact actuatable by a bimetallic switching member and a stationary counter contact with the contact and counter contacts being connected so as to be electrically conductive with the respective fixed connection elements at a predetermined temperature such that they are either electrically connected with each other by the bimetallic member or separated from each other.

23 Claims, 6 Drawing Figures

FIG. 5
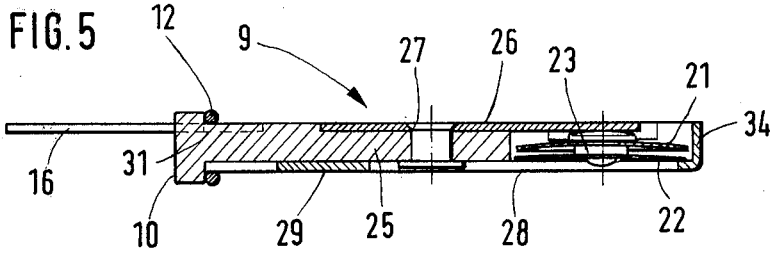
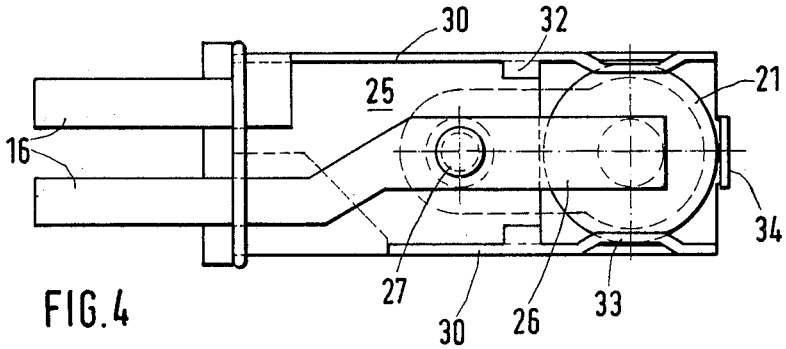
FIG. 4
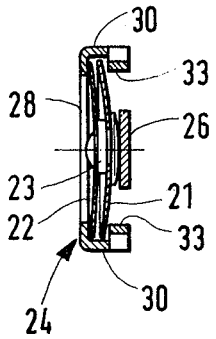
FIG. 6

COIL FORM WITH HEAT SWITCH

The present invention relates to a coil form and, more particularly, to a coil form and a heat switch adapted to be accommodated in the coil form with the coil form having at least one coil winding, whereby the heat switch comprising a switch element and a housing is introduced into a recess of the coil form that is located inside the winding.

In the field of electrical technology, coils are largely utilized in, for example, transformers, induction devices, etc and generally include at least one coil winding and a coil form on which the coil is wound. Because of the transformed electrical power, such coils regularly undergo heating during operation which, in some circumstances, especially in the case of overloads caused by operational disturbances, may lead to thermal damage of the coil.

To prevent thermal damage due to an overload or the like, it has been proposed to provide at least one heat switch in a heat conducting connection with the coil on the coil on the coil form, with the heat switch being adapted to interrupt a flow of electric current if a given predetermined temperature is exceeded. For this purpose, the heat switch is generally connected in series with the winding directly on the coil.

Various arrangements have been proposed for disposing a heat switch on a form of the coil. For example, an unencapsulated or unhoused switch may be introduced into an open depression or recess on the outside of the coil form and connected, with its connecting wires of leads, to current leads of the coil winding. While this proposed construction admittedly entails a minimal outlay, it is very disadvantageous since the heat switch is entirely unprotected against ambient influences and also is in inadequate heat-conducting connection with the place where the heat occurs, i.e., essentially the coil winding so that there is no adequately acceptable protection for the coil.

In a further proposed construction, the coil form may be provided with an open recess which, in the finished state, is covered over by the coil winding. A fuse may be introduced into the recess through a slit below the connecting strip of the coil form with the fuse, in an assembled state, being directly connected electrically with the connecting lug provided on the strip. While it is true that in this proposed construction there is a more effective protection against thermal overload because the fuse is in good heat conducting connection both with the coil winding and the core in which heat is released, a disadvantage resides in the fact that the fuse is irreversible and only works a single time before it has to be replaced.

In yet a further proposed construction, a recess may be provided inside the coil, i.e., inside the coil winding and on the housing core of the coil form which defines the winding diameter, with the recess extending in a direction parallel to the longitudinal direction of the winding, into which recess a conventional encapsulated heat switch may be introduced.

In this connection, the phrase "heat switch" in the framework of the present invention, means switch elements that usually are equipped with a bimetal switching element and that cut off the electric current when a given temperature is exceeded and switch on the electric current after a lowering of such temperature. With the present state of the art, from which the invention proceeds, the heat switch is well protected against ambient influences particularly against penetration of dust and moisture and is also disposed in relatively good contact with the heat generating regions of the coil; however, there are still various disadvantages with the heat switch. More particularly, there is an undesired great structural height and therewith a reduction of the available winding space since the recess in the coil form must be made somewhat larger to accommodate the walls of the heat switch housing. These as well as the air space existing between the wall of the recess and the housing of the heat switch hinder the heat transferred to the heat switch so that its sensitivity leaves something to be desired. Additionally, a full encapsulation of the heat switch is relatively expensive.

The aim underlying the present invention essentially resides in providing a coil form adapted to accommodate heat switches of the aforementioned type which requires the least possible space for the heat switch and which ensures a precise response of the heat switch, as well as a heat switch adapted to be accommodated in the coil form.

In accordance with advantageous features of the present invention, a recess provided in the coil form may be sealingly closed off by a housing of the heat switch with the housing of the heat switch being open at least in a region that penetrates into the recess. By virtue of these features of the present invention, a protection of the heat switch with respect to dust, moisture etc. is not obtained by complete encapsulation of the heat switch but rather by the fact that the recess, which is otherwise entirely closed, is so closed upon the introduction of the heat switch by the housing of the heat switch so that the heat switch is withdrawn and protected from all ambient influences.

Moreover, since the heat switch no longer is accommodated in a completely closed housing, a better thermal transfer is ensured. Additionally, the internal dimensions in the recess of the coil form may be smaller by an amount corresponding at least to the dimensions of the housing walls of the heat switch which were eliminated so that, on the whole, there is a substantial reduction of the extra height previously needed to accommodate the heat switch. In practice, such reduction in height may amount to, for example, 1 to 1.5 mm thereby making more space readily available to serve as a winding space of the coil. Moreover, there is a reduction in the overall costs since a full encapsulation of the heat switch may be avoided and there is no extra significant additional outlay for effecting a seal between the switch and the recess.

In accordance with the present invention, the heat switch housing merely includes an open retaining part for holding the switch mechanism which, advantageously, may consist of a front plate that closes off the recess of the coil form, that is, engages therein or engages over an opening of the recess, and a supporting element connected to the front plate and penetrating into the recess. An elastic sealing means such as a gasket or the like may be disposed between the front plate and coil form so as to surround the recess and ensure a sealing between the heat switch and the coil form.

Various possibilities exist for fixing the heat switch in the recess of the coil form. More particularly, an adequately fixed seat with a good seal may simply be produced by introduction of the heat switch with a positive or frictional engagement into the recess of the coil form. It is also possible in accordance with the present invention to lock the heat switch in the recess by means of an appropriate positive engaging means such as, for example, prongs, locking projections, etc.

With regard to the electrical connection of the heat switch, preferably, in accordance with the present invention, the recess is provided in a connection strip of the coil form that has the usual connecting lugs and, in certain circumstances, extends beyond the core form into the interior of the coil with the heat switch presenting rigid connecting elements protruding along its front plate whereby the arrangement is such that the connection elements may be contacted directly by the lugs.

Advantageously, to fix the heat switch at the coil form, the connection lugs, or at least those that serve for electrical connection of the heat switch, may be adapted to slide essentially perpendicular to a direction of introduction of the heat switch into the recess with the heat switch, when it is installed, being adapted to be locked in the recess with contact of the connection elements by the lugs. In other words, after an introduction of the heat switch into the recess, the connection lugs are slid in, in such a manner, that they prevent the switch from coming out of the recess and at the same time are in electrical contact with its connection elements. To avoid a pulling out of the lugs by a pulling on the wires or leads which are connected to them, advantageously, the lugs may be lockable with a positive engagement in the core form, in the locking position.

There are numerous possibilities for the design of the heat switch itself wherein, in general, at least one bimetallic snap element and a fixed contact tongue are provided that are joined to the supporting element by, for example, gluing, bending, riveting, or the like. Such an arrangement of the contact tongue and bimetal snap element represents the simplest kind of heat switch which allows a very low structural height; however, the precision of the response has a disadvantageous effect in that the bimetal snap element of the heat switch has the electric current that is to be switched flowing therethrough.

To avoid the above noted disadvantageous effect, in German Pat. No. 21 21 802, a heat switch is proposed wherein a cap-shaped bimetallic snap plate and cap-shaped spring snap plate provided with a central contact and centrally connected with the bimetal snap plate as a current transmitting member are provided. The cap-shaped spring snap plate has a lower switching force as compared to the bimetallic snap plate so that the current that is to be switched flows through the central contact and spring snap plate while the bimetallic snap plate alone serves for the switching.

With a heat switch such as proposed in the above noted German patent, an open construction of such heat switch in accordance with the present invention is characterized by an extremely flat construction in that one of the connection elements may be in the form of a U-shaped sheet member with the base body of the switch presenting an extension made of an insulating material which penetrates, with positive engagement, into an interior of the U-shaped profile piece, with the other connection element consisting of a contact tongue connected with the extension portion penetrating into the interior of the profile of the U-shaped sheet and supporting the counter contact.

In addition to its electrical function, the U-shaped connection element assumes another function as a supporting structure so that, independently of a switch housing that may be provided, there results a great intrinsic rigidity and manipulability of the heat switch. Moreover, a precise disposition of the contacts is ensured in that the contact tongue that supports the counter contact is disposed on an extension of the base body which, in turn, is fixed with positive engagement in the interior of the U-shaped sheet member. Thus, the connection elements may be readily made in such a way that, in a region of the base body of the heat switch, the electrical connection is effected independently of the mechanical fastening of the heat switch laterally, that is, in a direction parallel to the longitudinal direction of the U-shaped member.

With a cap-shaped bimetallic snap plate provided as the bimetallic switch member which, in a conventional manner, may be peripherally loose, the present invention provides that the bimetallic snap plate is guided between arms of the U-shaped member, with an extension in and a projection disposed on a side of the crosspiece of the U-shaped member that is opposite to the base body. Advantageously, the projection is integrally formed with the crosspiece and made, for example, by stamping with the projection subsequently being correspondingly bent down.

Advantageously, in accordance with the present invention, it is recommended that the bimetallic snap plate be so disposed that it is under no stress and, hence, it is not subjected to long range fatigue, in one snap position and braced on backups or stops provided on the arms of the U-shaped member in the other snap position.

To provide for backups or stops, advantageously, in accordance with the present invention, straps may be bent downwardy or outwardly from the U-shaped arms of the supporting element which straps serve as the backups or stops. For more precision, preferably, an arrangement is made whereby flutes are stamped on the U-shaped pieces that penetrate into the inner space of the profile or U-shaped piece, on which the bimetallic snap plate braces.

As noted above, the present invention essentially proceeds from a contruction in which, in addition to the cap-shaped bimetallic snap plate, there is a provision of a spring snap plate that is likewise cap shaped and that has less switching force than the bimetallic snap plate whereby the contact is centrally connected, on the one hand, with the bimetallic snap plate and, on the other hand, with the spring snap plate. Transmission of an electrical current is ensure in that the spring snap plate is braced on the crosspiece of the U-shaped member so as to be electrically conductive.

The various possibilities also exist for the arrangement of the contact tongue of the heat switch. For example, the contact tongue may be embedded in the extension portion of the base body by, for example, injection molding, casting, etc. To maintain the necessary distance from the crosspiece of the U-shaped member for the actual switch mechanism, i.e., preferably a bimetallic snap plate, spring snap plate, and contact, the contact tongue may be bent up outside the extension portion in such a way that there is a uniform cross sectional profile over the whole length of the heat switch.

It is also possible in accordance with the present invention for the contact tongue which is preferably set in snugly closing off a corresponding depression or recess in the extension portion, to be joined to the extension portion by a rivet or the like. To reduce the height, the crosspiece of the U-shaped member may be provided with a recess that surrounds the rivet at a distance so that the rivet head will not protrude. Moreover, the recess may extend as a long slot into a region of the snap spring plate and may be widened thereat so that a heat shielding by the crosspiece will be prevented. As can be appreciated, the dimensioning of the recess are so selected that there is a secure bracing of the spring snap plate.

As noted above, the electrical connection of the heat switch may be affected advantageously by means of laterally extending connecting straps which extend parallel to the longitudinal direction of the U-shaped member. For this purpose, the connecting element belonging to the contact tongue may go over simply into such a connection strap. As to the connection of the U-shaped sheet member, advantageously, a connection strap may be shaped on one of the arms of the U-shaped member which strap is bent around, with a fastening of the base body, around the inner cavity of the U-shaped member so that the connection strap simultaneously serves for fastening of the base body to the U-shaped member.

In accordance with further provisions of the present invention, retaining straps are shaped on the arms of the U-shaped member with the straps being adapted to engage the extension of the base body, for example, being suitably stamped out and bent over the extension portion. The connection straps and/or the retaining straps advantageously snugly engage in suitable depressions in the base body or in the extension portion so that over an entire length, with the exception of the base body that extends beyond the U-shaped member, there are uniform cross sectional dimensions. These last mentioned arrangements allow production of a heat switch in accordance with the present invention with a minimum components which may be installed in the simplest manner with considerable mechanization.

A heat switch in accordance with the present invention, can readily be introduced, in an open configuration, i.e., without a housing or a portion of the housing, into a corresponding recess provided in an instrument. Advantageously, a seal is provided for sealing the heat switch in the recess of the instrument. There is also the possibility of a closed embodiment in which the heat switch is introduced into the housing and also sealed by, for example, bonding or by means of a suitable sealing agent. However, in either case, what will result is an extraordinarily flat construction provided with great mechanical stability.

A supporting element of the heat switch may, in accordance with the present invention, comprise a sheet of material having a U-shaped configuration with an extension being provided at a front of the material which extension consists of insulating material adapted to be engaged in a cavity of the U-shaped member and which is adapted to support a contact tongue on its side that opposes the crosspiece of the supporting element whereby, in the electric current through-flow position of the heat switch, the central contact and the spring snap plate connect the crosspiece and the contact tongue so as to be electrically conductive. What is provided first is that the spring snap plate and the bimetallic snap plate are laterally guided between the arms of the U-shaped support element and the extension portion at the front of the support element and a projection shaped on the end of the support element that is opposite the front of the element. Advantageously, the projection is bent down from the crosspiece of the support element. As a backup for the bimetallic snap plate, straps may be bent down, for example, from the arms of the U-shaped supporting element however, as noted above, preferably for precision flutes are stamped on the arms of the U-shaped supporting element which flutes penetrate into the cavity of the U-shaped profile member with the bimetal snap plate being adapted to be braced on the flutes in the high temperature position. In the low temperature position in which the heat switch is closed, the bimetallic snap plate may be free of stress in any case.

Accordingly, it is an object of the present invention to provide a coil form with a heat switch which avoids, by simple means, shortcomings and disadvantages encountered in the prior art.

Another object of the present invention resides in providing a coil form with a heat switch which is simple in construction and therefore relatively inexpensive to manufacture.

Another object of the present invention resides in providing a coil form adapted to accommodate heat switches which ensures a precise response by the heat switch to ambient conditions.

A further object of the present invention resides in providing a coil form and a heat switch which ensures a proper heat transfer to the heat switch so that an optimum sensitivity is obtained.

A still further object of the present invention resides in providing a coil form adapted to accommodate heat switches which ensures a protection of the heat switch from exposure to contaminates.

Another object of the present invention resides in providing a coil form adapted to accommodate heat switches which makes available additional space which serves as a winding space for the coil.

A still further object of the present invention resides in providing a heat switch arrangement which is adapted to be utilized in transformers, conduction devices, and other electrical aparatus which protects the aparatus from an overload caused by operational disturbances.

Another object of the present invention resides in providing a heat switch which minimizes if not avoids any thermal damage to coils or the like of electrical apparatus.

These and other objects, features and advantages of the present invention will become more apparent from the following description when taken in connection with the accompanying drawings which show, for the purposes of illustration only, two embodiments in accordance with the present invention, and wherein:

FIG. 4 is a top view of an embodiment of a heat switch in accordance with the present invention;

FIG. 5 is a longitudinal cross sectional view of the heat switch of FIG. 4; and FIG. 6 is a cross sectional view of the heat switch of FIG. 4.

Figure 2:
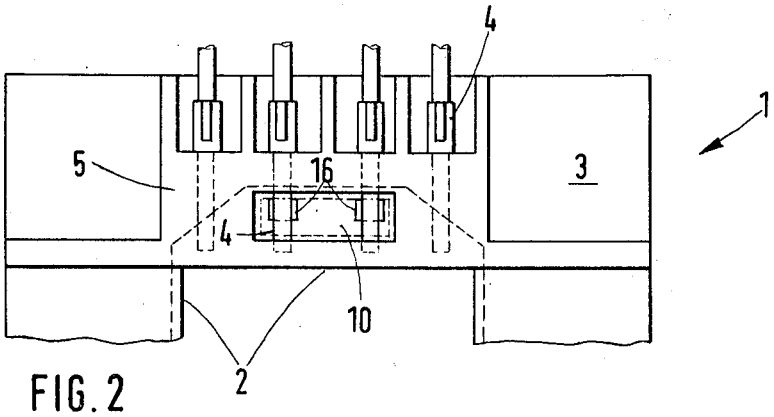
FIG. 2 is a front view of the coil form and heat switch of FIG. 1.
Figure 1:
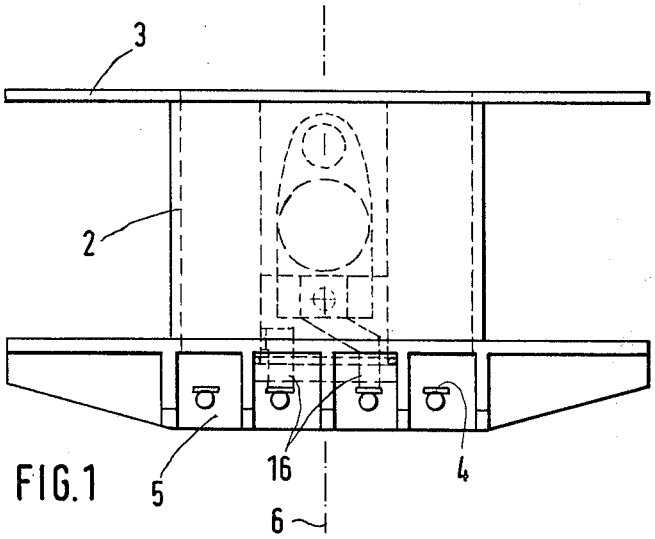
FIG. 1 is a top view of a coil form adapted to accommodate a heat switch in accordance with the present invention.

Referring now to the drawings wherein like reference numerals are used throughout the various views to designate like parts and, more particularly, to FIGS. 1 and 2, according to these Figures, a coil form generally designated by the reference numeral 1, in its basic construction, includes a core housing 2 for determining a minimum winding diameter and flanges 3 connected thereto for determining the winding length of the coil. A shaped connection strip 5, studded with connecting lugs 4, is provided on one of the flanges 3 and, in the space defined between the flanges 3, a coil winding (not shown) may be disposed.

Figure 3:
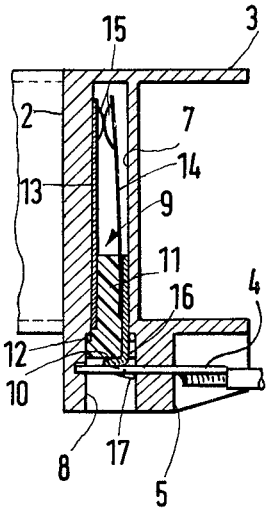
FIG. 3 is a cross sectional view of the coil form and heat switch of FIG. 1.

As shown most clearly in FIG. 3, one of the walls of the core housing 2 is thickened or widened and is provided with a recess 7 extending in a direction of the longitudinal axis designated by the reference numeral 6 (FIG. 1) of the coil winding. An opening 8 is provided in a region of the connection strip 5 and otherwise the recess 7 is closed on all sides. A heat switch generally designated by reference numeral 9 is introduced into the recess 7 through the opening 8.

By virtue of the disposition of the heat switch 9 in the recess 7, a housing of the heat switch may be reduced to, for example, a front plate 10 and an insulating supporting element 11 connected to the front plate 10. The supporting element 11 penetrates or extends into the recess 7 and, in a zone that extends into the recess 7, the housing of the heat switch 9 is open. The recess 7 is closed by the front plate 10 and additionally sealed by a sealing element such as, for example, a sealing ring or gasket 12 made of an elastic material that surrounds the recess 7.

The heat switch 9 may include a fixed contact tongue 13 in a bimetallic strip member 14, with the tongue 13 and strip member 14 being connected with the insulating support element 11. In the illustrated low-temperature setting, the contacts 15 of the fixed contact tongue 13 and bimetallic strip member 14 are applied against each other so that an electric current flows through the switch and therewith through the coil winding (not shown).

When a given predetermined temperature is exceeded, the bimetallic strip member 14 lifts off the fixed contact tongue 13 so that a flow of electric current is interrupted. The contact tongue 13 and bimetallic strip members 14 are connected with the connection elements 16 so as to be electrically conductive. The connection elements 16 extend from the front plate 10 and are accessible from the outside. At least the connection lugs 4 that serve for the connection of the heat switch 9 are slidable in a direction perpendicular to the direction of introduction of the heat switch 9 into the recess 7 and therewith to the longitudinal axis 6 of the winding of the coil.

After an insertion of the heat switch 9 in the recess 7, the connecting lugs 4 are pushed in whereby the heat switch 9 is locked in position with an elastic compression of the sealing ring or gasket 12 and, at the same time, a direct electrical contact is established between the connection lugs 4 and the connection element 16. Impressions or projections 17 are provided on the lugs 4 and are adapted to enage a wall of the opening 8 when they are thrust in so that the lugs 4 are secured against an unintentional pulling out.

As shown in FIGS. 4, 5, and 6, a heat switch generally designated by the reference numeral 9' is provided wherein, in contrast to the heat switch 9, the bimetallic member or element thereof does not have the current that is to be switched flowing through it. More particularly, according to these figures, the actual switch arrangement includes a cap-shaped bimetallic snap plate 21 and a cap-shaped spring snap plate 22 which serves as a current transmitting member with the bimetallic snap plate 21 and spring snap plate 22 being concentrically connected with each other by a central contact 23.

The heat switch 9' of FIG. 4 is not provided with a housing and, as shown in FIG. 5, the heat switch 9' may be set into a recess or opening of a schematically illustrated electrical instrument generally designated by the reference numeral 35. In order to seal the heat switch 9' at the electrical instrument 35, a sealing means such as an elastic gasket 12 or the like is provided which surrounds the opening provided in the electrical instrument. It is also possible in a manner not illustrated in detail, to provide a heat switch which is set into a housing, i.e., a closed embodiment of the heat switch with the seal also being effected therein by a gasket or, advantageously, by a bonding of the base body 10' with the housing.

The heat switch 9' further includes a U-shaped member generally designated by the reference numeral 24 which may, for example, be made of sheet metal, and a base body 10' having an extension portion 25 that is adapted to penetrate, in positive engagement and without clearance into an inner cavity of the U-shaped member 24. A rigid contact tongue 26 is connected by a rivet 27 with the extension portion 25 which, like the base body 10', is made of insulating material. A forward end of the tongue 26 constitutes a stationary counter contact of the heat switch 9'. A crosspiece or bite portion 29 of the U-shaped member 24 is provided with a recess 28 (FIG. 6) in a region of the rivet 27, with the recess 28 surrounding the rivet 27 at a predetermined distance so that the head of the rivet 27 will not protrude or extend beyond the cross sectional profile of the sheet member 24. The rivet 27 is countersunk on a side of the contact tongue 26 so that what results is a flat profile without any projection or protrubences.

As noted above, in the heat switch of FIGS. 4–6, the cap-shaped spring snap plate 22 serves as an electric current transmitting member and the movable contact 23 centrally connects the bimetallic snap plate 21 and spring snap plate 22 with each other. The spring snap plate 22 is braced on the crosspiece 29 so as to be electrically conductive and is pressed by the crosspiece 29 into the illustrated current passage position against the contact tongue 26 whereby the bimetallic snap plate 21 is under no stress.

In the illustrated position, a flow of electric current is possible through the U-shaped member 24, spring snap plate 22, contact 23 and contact tongue 26. When a given predetermined temperature is exceeded, the bimetallic snap plate 21 snaps from the illustrated low temperature position into a concave high temperature position (not shown) with respect to the contact tongue 26 so that the contact 23, against the action of the spring snap plate 22, is removed from the contact tongue 26 and the flow of electric current is interrupted whereby the bimetallic snap plate 21 is braced on its edge on flutes 33 stamped into arms 30 of the U-shaped member 24 with the flutes serving as a backup or stop means for the snap plate 21.

When the temperature returns to a temperature that is below the predetermined temperature value, the internal forces of the bimetallic snap plate 21 allow the snap plate 21 to jump back and the contact 23 is again pressed against the contact tongue 26. The switch mechanism constituted by the bimetallic snap plate 21, spring snap plate 22 and contact 23 is laterally guided by the extension portion 25, and arms 30 of the U-shaped membr 24 as well as a projection 34 shaped on and bent upward at the forward end of the crosspiece 29.

The electrical connection of the illustrated heat switch 9' of FIGS. 4–6 is effected by way of the connecting straps 16, 17 which extend, by way of the base body 10', out in a direction parallel to the longitudinal direction of th profile of the U-shaped member 24. The contact tongue 26 also goes over into or is formed as a portion of one of the connecting straps 16 and the connecting strap 17 is shaped or formed in one piece on one of the arms 30 of the U-shaped member 24 and bent over into a recess 31 of the base body 10 or extension portion 25 so that it is firmly held in the cavity of the U-shaped member 24. For the same purpose, in a forward zone of the arms 30, shaped on straps 32 (FIG. 4) are bent over into corresponding depressions or recesses provided in the extension portion 25. To prevent a heat-shielding action by the crosspiece 29, the recess 28 surrounding the rivet 27 is extended below the spring snap plate 22 and is also widened.

While I have shown and described several embodiments in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A coil form for accommodating at least one coil winding and a heat switch means, the coil form including a recess means for receiving the heat switch means, the heat switch means including at least one switching element and a housing means at least a portion of which is adapted to be inserted into the recess means, characterized in that the housing means is open at least in an area thereof adapted to be inserted into the recess means, and in that the housing means includes means for closing off the recess means.

2. A coil form according to claim 1, characterized in that the means for closing off the recess means includes a plate member, and in that the housing means includes a supporting element connected to the plate member and adapted to extend into the recess means.

3. A coil form according to claim 2, characterized in that means are provided for sealing the housing means at the recess means.

4. A coil form according to claim 3, characterized in that said sealing means is an elastic sealing element surrounding the recess means.

5. A coil form according to one of claims 1, 2, 3, or 4, characterized in that means are provided for locking the heat switch means in the recess means.

6. A coil form according to one of claims 1, 2, or 3, characterized in that the coil form further includes a connection strip, said recess means is provided in the connection strip, connection lug means are provided for enabling a connecting of electrical leads to the heat switch means, and in that rigid connecting elements are provided on the plate member and are adapted to contact the lug means for establishing a direct electrical contact between the connecting elements and the lug means.

7. A coil form according to claim 6, characterized in that means are provided in the connection strip for enabling the connecting lug means to be slid therein in a direction substantially perpendicular to an insertion direction of the housing means into the recess means, and in that means are provided on the connection lug means for enabling a locking of the housing means in the recess means when the lug means are in contact with the rigid connecting elements.

8. A coil form according to claim 7, characterized in that the means for enabling the locking of the housing means in an inserted position includes means for positively engaging a portion of the coil frame.

9. A coil form according to claim 8, characterized in that said means for positively engaging includes projections provided on the lug means.

10. A coil form according to claim 1, characterized in that the heat switch means further includes a base body portion, fixed connection elements are provided on the base body portion with the fixed connection elements being insulated from one another, said base body portions serving as said means for closing off the recess means, said at least one switching element includes a bimetallic switching member, said heating switch means further includes a contact means actuable by the bimetallic switching member and a stationary counter contact means, said contact means and counter contact means are connected so as to be electrically conductive with the respective fixed connection elements at a predetermined temperature such that they are either selectively connected with each other by the bimetallic member or separated from each other.

11. A coil form according to claim 10, characterized in that one of the fixed connection elements is a U-shaped sheet-like member, the base body portion includes an extension portion of insulating material that extends into and positively engages an inner space of the U-shaped member, and in that another one of the connection elements is a contact tongue means for carrying the counter contact means, said contact tongue means is connected to the extension portion.

12. A coil form according to claim 11, characterized in that the bimetallic switching member is a cap-shaped bimetallic snap plate loosely peripherally guided between arms of the U-shaped member, the extension portion, and a projection disposed on a side of a crosspiece of the U-shaped member disposed opposite the base body portion.

13. A coil form according to claim 12, characterized in that the bimetallic snap plate is displaceable between two positions, and in that in one position the snap plate is free of stress and in the second position the snap plate is braced against stop means provided on the arms of the U-shaped member.

14. A coil form according to claim 13, characterized in that the stop means are formed as flutes stamped into the arms of the U-shaped member.

15. A coil form according to one of claims 12, 13, or 14, characterized in that the contact means is connected centrally with the bimetallic snap plate and with a cap-shaped spring snap plate, said spring snap plate serves as an electrical current transmitting member, and in that said spring snap plate is electrically conductively supported on the crosspiece of the U-shaped member.

16. A coil form according to claim 15, characterized in that the contact tongue means is embedded in the extension portion.

17. A coil form according to claim 15, characterized in that a fastening means is provided for connecting the contact tongue means to the extension portion.

18. A coil form according to claim 17, characterized in that a recess is provided in the crosspiece of the U-shaped member and surrounds the fastening means with a predetermined spacing.

19. A coil form according to claim 18, characterized in that the recess in the crosspiece extends into an area of the spring snap plate.

20. A coil form according to claim 19, characterized in that the heat switch means further includes connection strip means for enabling a connection of the heat switch means to electrical leads, and in that the connection strip means is shaped on one of the arms of the U-shaped member and is bent over in a direction toward the inner space of the U-shaped member so as to fix the base body portion.

21. A coil form according to claim 20, characterized in that retaining strap means are provided on the arms of the U-shaped member for engaging the extension portion.

22. A coil form according to claim 21, characterized in that at least one of the retaining strap means and the connection strap means are adapted to engage in depressions provided in the base body portion of the extension portion.

23. A heat switch comprising a cap-shaped bimetallic snap plate, a cap-shaped spring snap plate centrally connected with the bimetallic snap plate and forming an electric current transmitting member, a U-shaped sheet member serving as a supporting element for the heat switch, a central contact provided on the spring snap plate, said spring snap plate having less switching force than the bimetallic snap plate, a body portion of insulating material, an extension portion of insulating material provided on said body portion, said extension portion being adapted to engage in an inner space of the U-shaped member, a contact tongue provided on the extension portion on a side thereof opposite a crosspiece of the U-shaped member, the spring snap plate and bimetallic snap plate being adapted to be laterally guided between arms of the U-shaped member, a forward end of the extension portion, and a projection provided on an end of the U-shaped member opposite the body portion such that in an electrical current passage setting of the heat switch means, the central contact and spring snap plate connect the crosspiece of the U-shaped member and the contact tongue so that they are electrically conducting.

* * * * *